US009296587B2

(12) United States Patent
Gonzalez et al.

(10) Patent No.: US 9,296,587 B2
(45) Date of Patent: Mar. 29, 2016

(54) MULTIFUNCTIONAL SPOOL TOOL

(71) Applicant: TRICORNE, LLC, Santee, CA (US)

(72) Inventors: Gino Gonzalez, Santee, CA (US); Robert Fogg, San Diego, CA (US)

(73) Assignee: TRICORNE, LLC, San Diego, CA (US)

( * ) Notice: Subject to any disclaimer, the term of this patent is extended or adjusted under 35 U.S.C. 154(b) by 0 days.

(21) Appl. No.: 14/736,927

(22) Filed: Jun. 11, 2015

(65) Prior Publication Data

US 2015/0274481 A1 Oct. 1, 2015

Related U.S. Application Data

(63) Continuation of application No. 13/965,974, filed on Aug. 13, 2013, now abandoned, and a continuation-in-part of application No. 13/916,565, filed on Jun. 12, 2013, now abandoned.

(60) Provisional application No. 61/702,218, filed on Sep. 17, 2012, provisional application No. 61/659,260, filed on Jun. 13, 2012.

(51) Int. Cl.

| | |
|---|---|
| ***B65H 54/68*** | (2006.01) |
| ***B25F 1/00*** | (2006.01) |
| ***B26B 27/00*** | (2006.01) |
| ***D07B 7/16*** | (2006.01) |
| ***B65H 75/06*** | (2006.01) |
| ***B65H 75/28*** | (2006.01) |
| ***B65H 75/32*** | (2006.01) |

(52) U.S. Cl.

CPC *B65H 54/68* (2013.01); *B25F 1/00* (2013.01); *B26B 27/00* (2013.01); *B65H 75/06* (2013.01); *B65H 75/28* (2013.01); *B65H 75/32* (2013.01); *D07B 7/16* (2013.01); *B65H 2701/35* (2013.01); *B65H 2701/533* (2013.01)

(58) Field of Classification Search

CPC ..... B25F 1/00; B65H 75/06; B65H 75/28; B65H 75/32; B65H 75/34; B65H 2701/35; B65H 2701/533; B65D 85/04; B65D 85/677

See application file for complete search history.

(56) References Cited

U.S. PATENT DOCUMENTS

| | | | | |
|---|---|---|---|---|
| 2,802,259 | A * | 8/1957 | Stoner | 30/429 |
| 3,133,683 | A * | 5/1964 | Deacon, Sr. | 225/62 |
| 3,901,458 | A * | 8/1975 | Kuncz, Jr. | 242/405.2 |
| 4,363,147 | A * | 12/1982 | Deweese | 7/158 |
| 2014/0059782 | A1 * | 3/2014 | Duncan et al. | 7/138 |

* cited by examiner

*Primary Examiner* — David B Thomas

(74) *Attorney, Agent, or Firm* — Coastal Patent Law Group, P.C.

(57) ABSTRACT

A multifunctional spool tool having a body with winding edges for winding a utility cord thereabout, and one or more of: a lighter clip and lighter, a cutting blade, a notch for fusing the utility cord, or a supplemental component such as a flashlight, compass, knife, fire starter, magnifying glass, screwdriver, measuring device, pen, storage device, magnesium striker, can opener, safety belt knife, skinning knife, tweezers, toothpick, or a signal mirror.

19 Claims, 7 Drawing Sheets

MULTIFUNCTIONAL SPOOL TOOL

CROSS-REFERENCE TO RELATED APPLICATIONS

This application is a continuation (CON) of U.S. Ser. No. 13/965,974, filed Aug. 13, 2013, titled "MULTIFUNCTIONAL SPOOL TOOL"; which claims benefit of priority with U.S. Ser. No. 61/702,218, filed Sep. 17, 2012; and is a continuation in part (CIP) of U.S. Ser. No. 13/916,565, filed Jun. 12, 2013, titled "HAND-HELD TOOL FOR STORING, MEASURING, CUTTING, AND HEAT SEALING PARACORD"; which claims benefit of priority with U.S. Ser. No. 61/659,260, filed Jun. 13, 2012;

the contents of each of which are hereby incorporated by reference.

BACKGROUND OF THE INVENTION

1. Field of the Invention

This invention relates to a multifunctional spool tool for use with utility cord; and more particularly, to such a multifunctional spool tool adapted for use with multiple utility applications in addition to storage and management of the utility cord.

More specifically, this invention relates to a multifunctional spool tool having different combinations of: a utility cord winder; cutting blade; cord fusing device; flashlight; compass; knife; fire starter; magnifying glass; screwdriver; measuring device; pen; storage device; magnesium striker; can opener; safety belt knife; skinning knife; tweezers; toothpick; and signal mirror.

2. Description of the Related Art

"Paracord", or parachute cord, is a lightweight nylon kern-mantle rope, or rope constructed with its interior core (the kern) protected with a woven exterior sheath (mantle) that is designed to optimize strength, durability, and flexibility.

Since its use during WWII as a parachute cord, paracord has become increasingly popular in a variety of alternative applications, both in the military and for civilian applications.

As nylon braided cord, paracord can be cut but must be fused to prevent the mantle from becoming frayed or unwound at the cut. Fusing is generally accomplished by melting the fibers at the end of a freshly cut segment of cord such that the fibers can become fused together.

Additionally, a myriad of alternative utility cords are presently available for military and civilian uses. Many of these alternative utility cords also require fusing at the end of a freshly cut segment for preventing unwinding or fraying.

A variety of spools and winders exist for use with various wires, ropes and utility cords, however there has yet to be provided such a winder adapted to facilitate fusing of a cord disposed thereon.

Additionally, there has yet to be provided a spool or winder adapted for cutting and fusing utility cord, and one or more of: a flashlight; compass; knife; fire starter; magnifying glass; screwdriver; measuring device; pen; storage device; magnesium striker; can opener; safety belt knife; skinning knife; tweezers; toothpick; and signal mirror.

As utility cords such as paracord have become increasingly popular in a variety of activities such as camping, sports, and other outdoor activities, and with increased use in military applications, there is a present need for a utility cord winder adapted for cutting and fusing of an amount of cord and storing a length of cord wound thereon. In addition, it would be beneficial to provide a variety of tools used in these and other outdoor and recreational activities.

SUMMARY OF THE INVENTION

Accordingly, this invention solves these and other problems in the art by providing a multifunctional spool tool adapted to securely and neatly maintain a length of utility cord, and further adapted to cut and fuse the utility cord thereon. Thus the multifunctional spool tool is adapted to replace a spool, knife, and heat fusing apparatus, providing reduced volume and weight when compared to the multiple distinct tools otherwise required, and thereby enhancing portability.

In addition to the storage of utility cord about the spool, and the cutting and fusing applications, the multifunctional spool tool may be further adapted to comprise one or more of: a flashlight; compass; knife; fire starter; magnifying glass; screwdriver; measuring device; pen; storage device; magnesium striker; can opener; safety belt knife; skinning knife; tweezers; toothpick; and signal mirror.

These and other features are hereinafter disclosed in more detail within the following detailed description.

BRIEF DESCRIPTION OF THE DRAWINGS

In accordance with various embodiments of the invention, a multifunctional spool tool for use in cutting, fusing, and storing an amount of utility cord is illustrated in the following drawings, wherein.

DETAILED DESCRIPTION OF THE PREFERRED EMBODIMENTS

Figure 1:
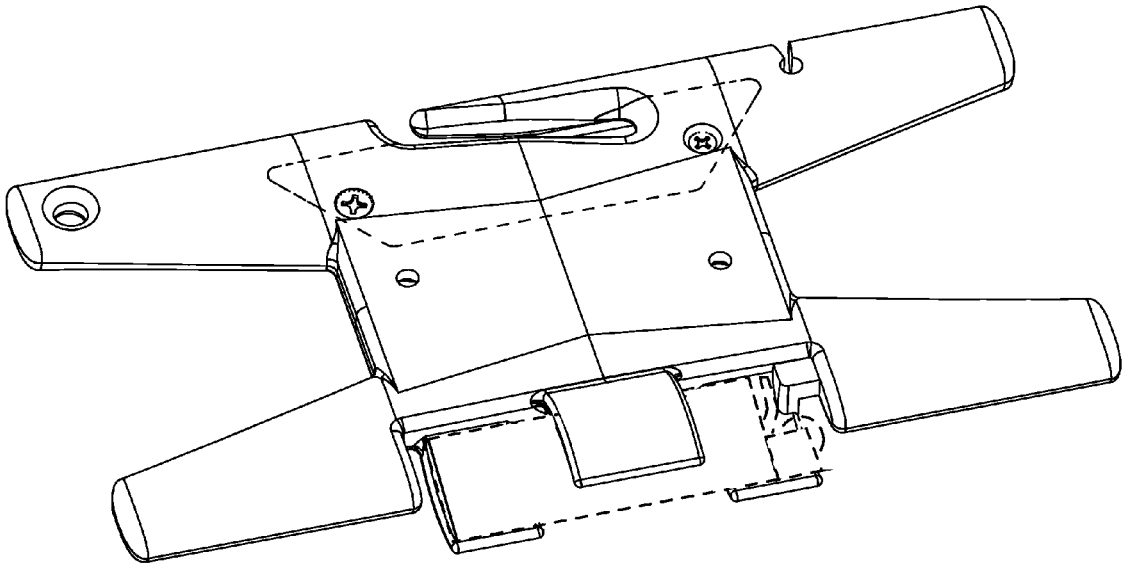
FIG. 1 illustrates a front perspective view of a multifunctional spool tool according to various embodiments, the spool tool is adapted to receive and retain a standard lighter (shown in dashed lines) within a lighter clip portion of the tool, and further adapted to provide a cutting blade for cutting utility cord (not shown).

Various features and advantages of this invention will become apparent from the following description of embodiments with reference to the accompanying drawings. Hereinafter, a preferred embodiment of the present invention will be described in more detail referring to the drawings and reference numerals associated thereof In a general embodiment, a multifunctional spool tool comprises a spool body having a built-in cutting blade adapted to cut a length of cord wound on the spool, and a fusing device mounted on the spool.

The fusing device can be a combination of a notch for holding a terminal end of a cord segment for fusing and a flame device such as a lighter for melting the terminal cord end, or an electric heat conductor adapted to melt the terminal end of a cord segment.

In one embodiment, the multifunctional spool tool comprises a substantially planar spool having a central body portion and four elongated prongs extending outwardly at four rectangular corners thereof to form an H-shaped structure, such that a first pair of the elongated prongs extend outwardly from the body portion in a first direction to form a first fork and a second pair of the four elongated prongs extend outwardly from the body portion in a second direction to form a second fork, wherein the second direction is opposite of the first direction and the forks extend in opposite directions from the body portion.

In one embodiment, the body portion further comprises a receptacle portion and a cover portion adapted to removably attach with the receptacle portion. A cutting blade, such as a razor blade, is received in the housing portion such that a cutting edge of the blade is exposed at a side of the spool body in a manner adapted for cutting a utility cord segment. The cover portion can further be adapted to attach to the body portion with one or more screws or fasteners and may further be adapted to securely fix the blade in a cutting position. The body portion may further comprise a safety finger extending therefrom such that a slot is formed between the safety finger and the body portion, wherein the cutting edge of the blade is exposed only within the slot and otherwise obstructed for preventing harm to a user. In this regard, the utility cord is inserted in the slot and cut against the blade.

In an alternative embodiment, a knife or other cutting instrument may be housed within the body portion and adapted to cut a segment of utility cord.

In another embodiment, a lighter is retained by a clip portion extending adjacent to the body portion of the multifunctional spool tool. The lighter clip may comprise two or more fixed jaws adapted to frictionally receive and retain a lighter.

The body portion may further comprise a notch or other feature adapted to grip a terminal end of a freshly cut cord segment for use during fusing with a lighter. In certain embodiments, the notch is adapted to securely hold the terminal end of the cord segment in a manner such that the terminal end of the cord extends in a direction orthogonal to the spool body, thereby allowing the spool body to function as a handle for safely holding the cord segment during a fusing process.

In an alternative embodiment, the spool tool may comprise a conductor strip and a power source for electrically heating the conductor strip, wherein the terminal end of the utility cord may be fused when held against the heated conductor strip. In various embodiments, a battery and wires or circuitry is housed within the body portion of the multifunctional spool tool.

Now turning to the drawings, FIG. 1 illustrates a representative embodiment of the invention, comprising a substantially planar spool body portion having four elongated prongs forming two opposing forks at opposite ends of a central body portion, a cutting blade exposed at a channel extending between a safety finger and the spool body, and a lighter clip adapted to frictionally receive and retain a lighter therein, the lighter is shown in dashed lines as it may comprise any conventional lighter device available for commercial purchase or otherwise known in the art.

Figure 2:
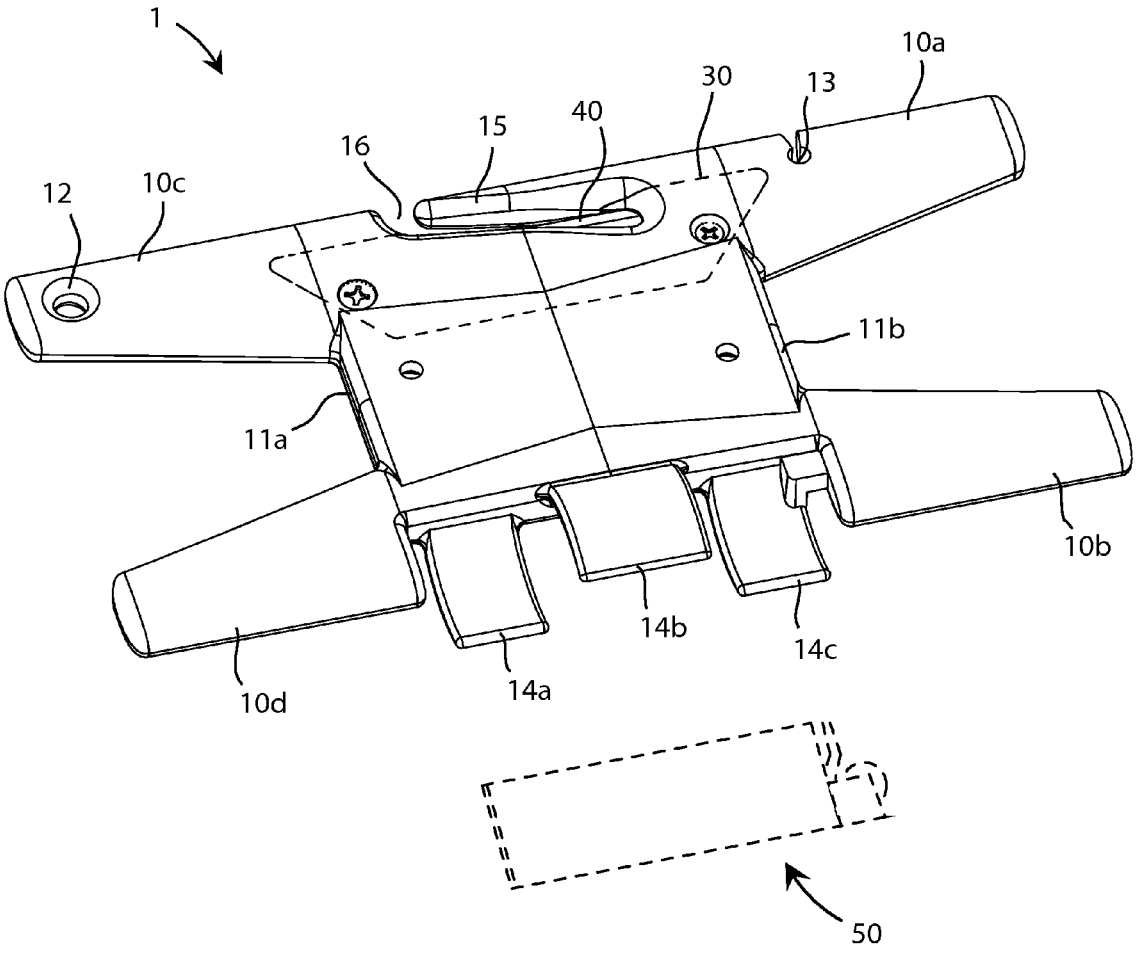
FIG. 2 illustrates a front perspective view of the multifunctional spool tool of FIG. 1, with the lighter being removed from the lighter clip portion of the tool.

FIG. 2 further illustrates the multifunctional spool tool of FIG. 1, with the lighter 50 removed. The spool tool 1 comprises a central body portion having a first winding edge 11*a* and a second winding edge 11*b* adapted to receive a length of utility cord wound thereabout. A first elongated prong 10*a* and second elongated prong 10*b* extend outwardly from the body portion in a first direction, thereby forming a first fork. A third elongated prong 10*c* and fourth elongated prong 10*d* extend outwardly from the body portion in a second direction, opposite of the first direction, thereby forming a second fork. The first and second forks are adapted to channel the utility cord as it is wound to form several loops about the first and second winding edges.

The multifunctional spool tool 1 may comprise a receptacle portion and a cover 30 shown in dashed lines. The receptacle portion is adapted to house a cutting blade 40, such as a razor blade, and is further adapted to receive one or more screws or fasteners to hold the blade and/or cover in an installed position. The body portion further comprises a safety finger 15 extending adjacent to a slot 16, the slot being disposed between the safety finger and the blade housing and adapted to safely expose a cutting edge of the blade within the slot region and otherwise obstruct the cutting edge at the safety finger for preventing harm to a user of the spool tool.

Additionally, the multifunctional spool tool 1 further comprises a lighter clip extending from the body portion and having at least two fixed clipping jaws 14*a*, 14*b*, 14*c*, adapted to frictionally receive and retain a conventional lighter 50. A notch 13 is disposed on the first elongated prong 10*a*, the notch comprises a slot and one or more teeth adapted to grip a terminal end of utility cord for holding the end of the cord during a fusing with the lighter. A lanyard hole 12 is provided for attaching a carabiner.

Optionally, the spool tool may comprise a lighter stop (18) built-in to the lighter clip portion of the spool tool. The lighter stop (18) comprises an extruded plastic volume extending into a lighter clip volume. The lighter stop is configured to prevent insertion of the lighter into the lighter clip in all but one orientation, that is, with the gas lever of the lighter adjacent with the lighter bump. In this orientation, the gas lever is prevented from accidental actuation and waste or loss of lighter fuel from within the lighter. In this regard, the spool tool is configured to secure the lighter in a manner for preventing waste or lost lighter fuel. Moreover, should the lighter be unintentionally actuated, the fumes could spark a fire, and thus presents a safety concern. This optional feature of a lighter stop provides added safety.

Figure 3:
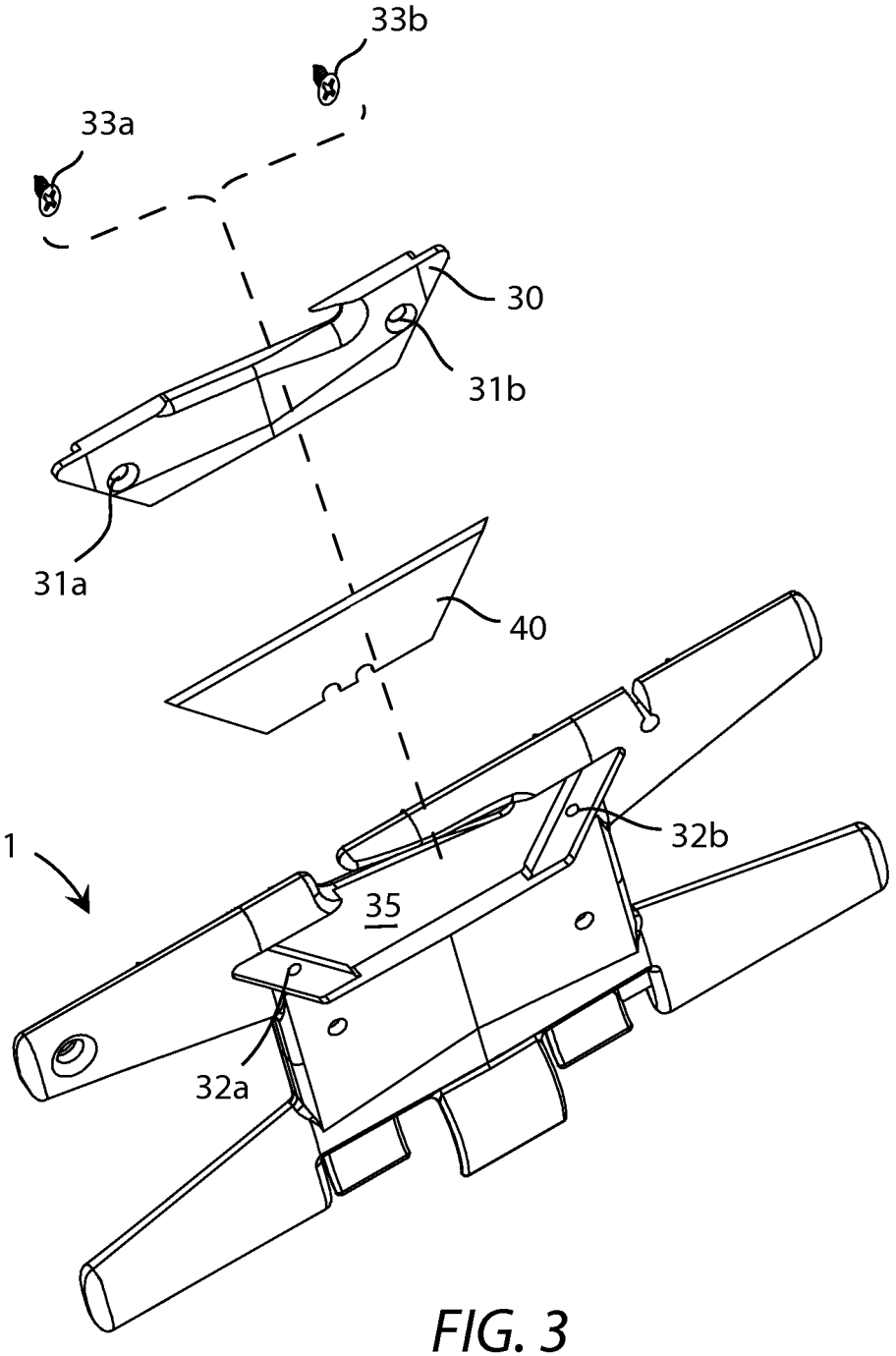
FIG. 3 illustrates an exploded view of the multifunctional spool tool and various components thereof; the spool tool includes a receptacle portion adapted to house a standard razor blade, a receptacle cover, and screws for affixing the cover about the receptacle portion with the blade being housed contained therein.

FIG. 3 illustrates an exploded view of the multifunctional spool tool 1, the spool tool comprising a housing portion 35 having one or more housing apertures 32*a*; 32*b* for receiving cover fasteners 33*a*; 33*b*, respectively. A blade 40 is adapted to sit within the housing portion of the spool tool body. A cover 30 further comprises a pair of cover apertures 31*a*; 31*b* for receiving the one or more cover fasteners 33*a*; 33*b*, respectively.

Figure 4:
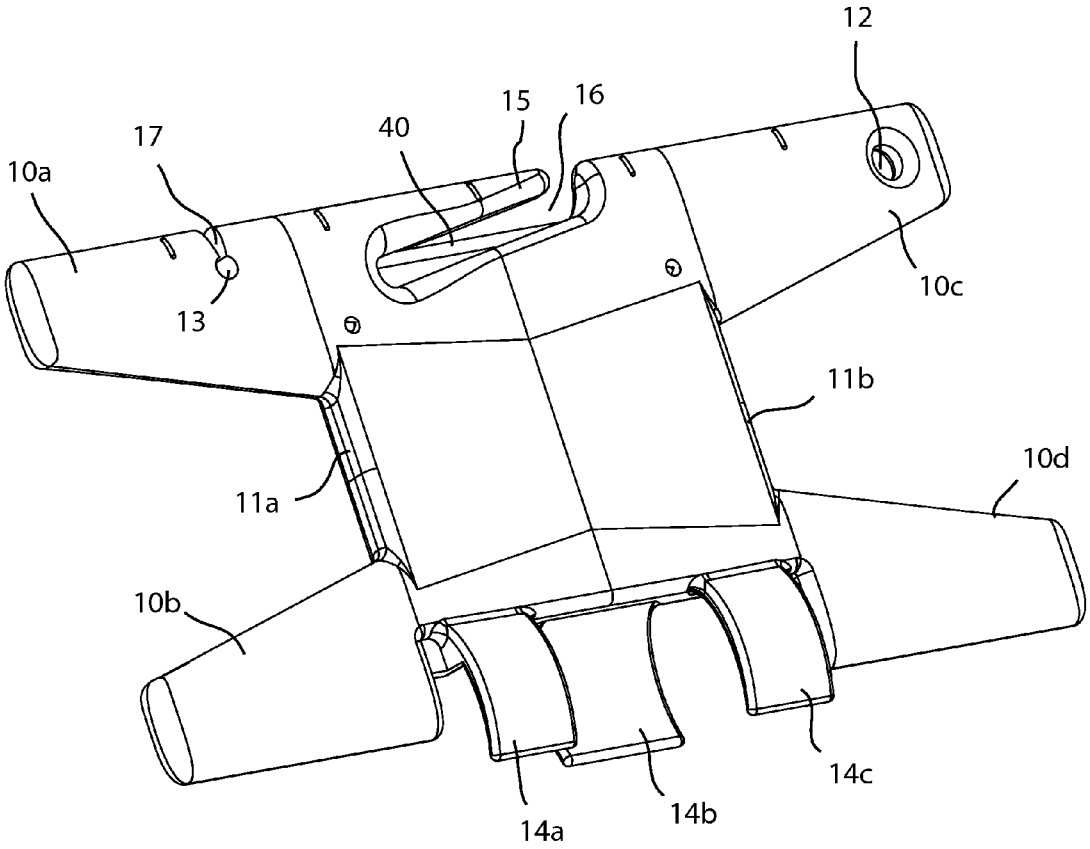
FIG. 4 illustrates a rear perspective view of the multifunctional spool tool and various components thereof.

FIG. 4 illustrates a rear view of the multifunctional spool tool as described in FIGS. 1-3, above. The spool tool comprises four elongated prongs 10*a*-10*d*, and two winding edges 11*a*; 11*b*, forming a spool for winding a length of utility cord thereon. A safety finger 15 obstructs an exposed cutting edge of a blade 40 for safety while promoting cutting of cord through access to the cutting blade at blade channel 16. Moreover, a lighter clip extends adjacent to the body of the tool and comprises a number of clipping jaws 14*a*-14*c*. A notch 13 comprises a slot 17 and one or more teeth for frictionally gripping a terminal end of utility cord for use during a fusing process. A lanyard hole 12 is provided for attaching a carabiner.

Figure 5:
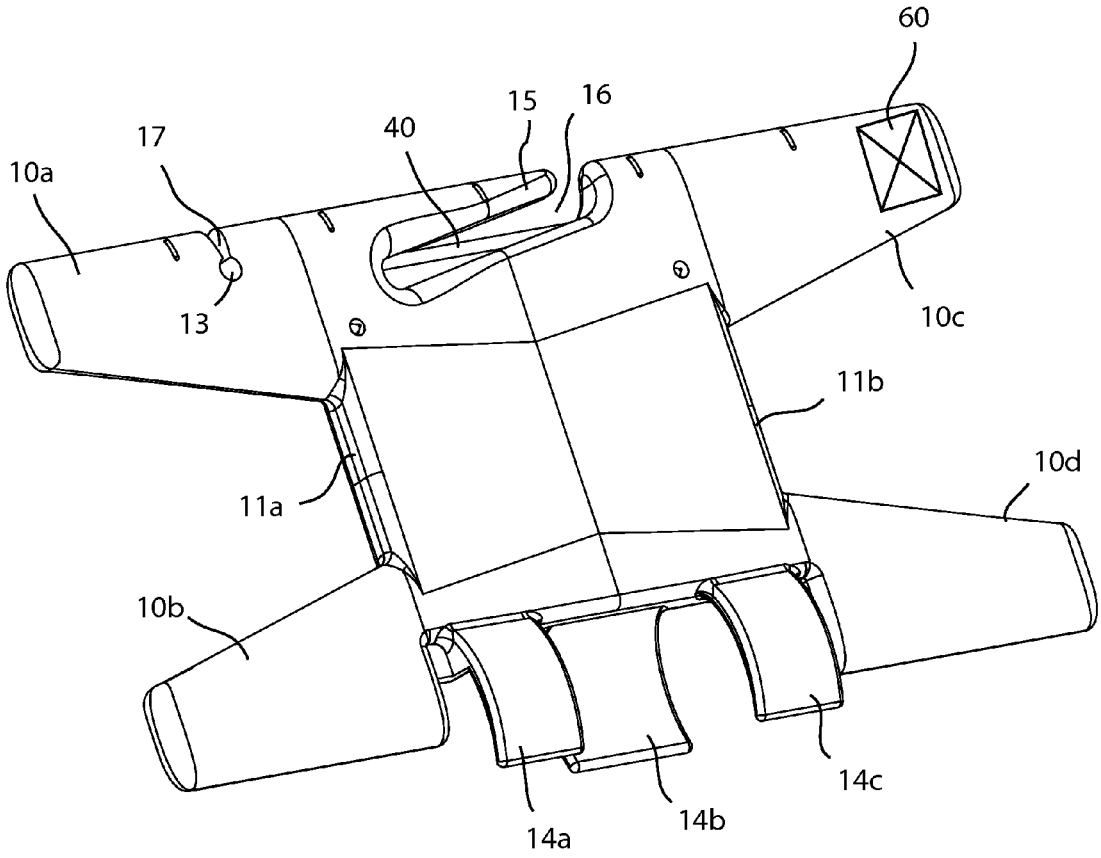
FIG. 5 illustrates a rear perspective view of the multifunctional spool tool having a supplemental accessory disposed on one of four elongated prongs.

FIG. 5 illustrates the multifunctional spool tool of FIGS. 1-4, the tool further comprises a supplemental component 60, illustrated as a box with an x therein for purposes of generalization, wherein the supplemental component 60 is disposed on one of the elongated prongs 10*c*. The supplemental component may comprise any of: a flashlight; compass; knife; fire starter; magnifying glass; screwdriver; measuring device; pen; storage device; magnesium striker; can opener; safety belt knife; skinning knife; tweezers; toothpick; and signal mirror, a combination thereof, or a related component.

With regard to the flashlight, the internal volume of the spool body may house a battery and wires or printed circuitry and the prong may house one or more light emitting diodes or other light bulbs for creating a functioning flashlight.

In certain embodiments, the battery and circuitry within the housing can further be used to power a fusing conductor (not shown) for fusing the terminal ends of a freshly cut segment of utility cord.

In alternative embodiments, portions of the spool body can be hollow for storing one or more supplemental components 60.

The notches can be disposed on one or more sides of the tool body, or one or more sides of the elongated prongs.

Figure 6:
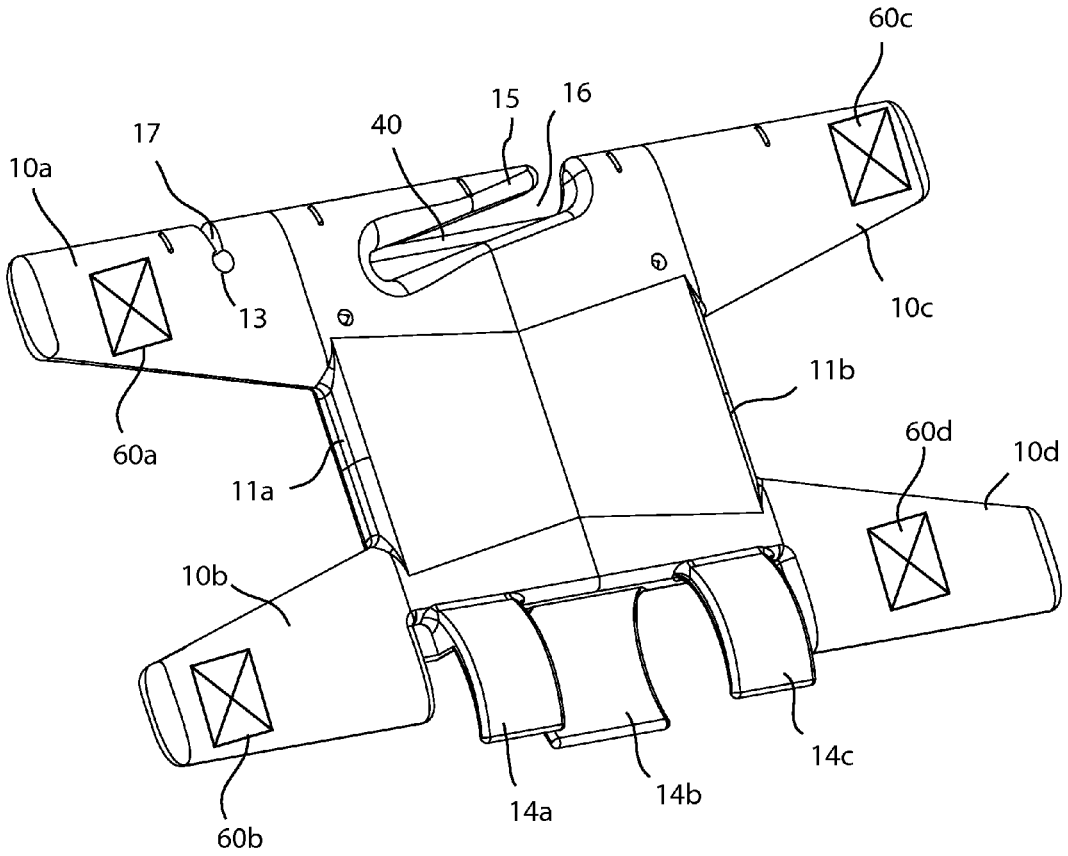
FIG. 6 illustrates a rear perspective view of the multifunctional spool tool having a supplemental accessory disposed each of four elongated prongs.

FIG. 6 illustrates another embodiment as described in FIGS. 1-5, wherein a plurality of elongated prongs are adapted to individually comprise one or more supplemental components 60*a*; 60*b*; 60*c*; 60*d*, respectively. It should be noted that in addition to the elongated prongs, the body portion of the spool tool may be further adapted to house one or more supplemental components. As described above, the supplemental components may individually comprise one or more of: a flashlight; compass; knife; fire starter; magnifying glass; screwdriver; measuring device; pen; storage device; magnesium striker; can opener; safety belt knife; skinning knife; tweezers; toothpick; and signal mirror, a combination thereof, or a related component.

Figure 7:
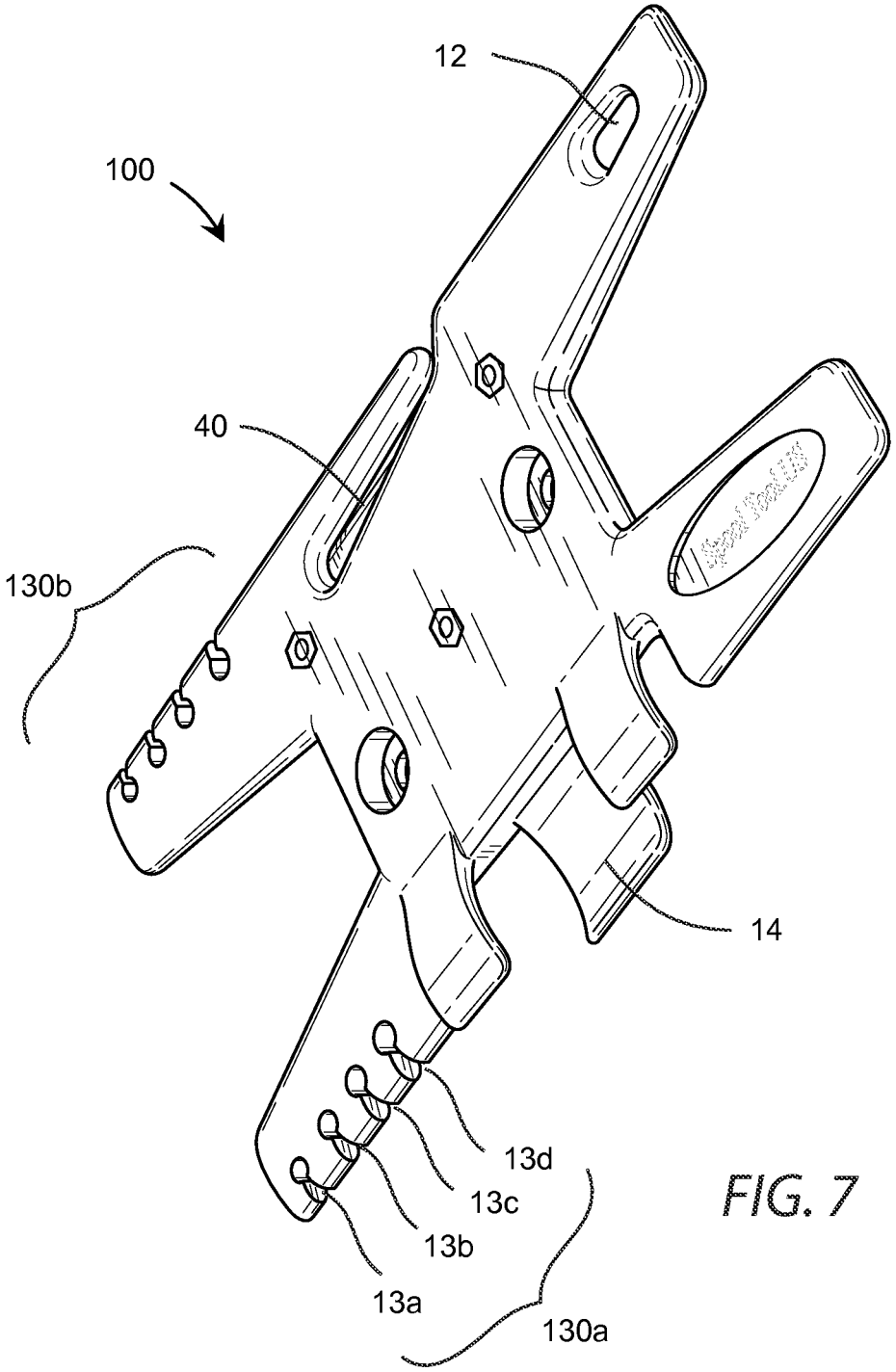
FIG. 7 illustrates a front perspective view of a multifunctional spool tool according to various other embodiments, the spool tool is adapted to receive and retain a conventional lighter within a lighter clip portion of the tool, adapted to receive and retain various sized utility cord in a series of slots disposed along the spool tool, and further adapted to provide a cutting blade for cutting utility cord.

FIG. 7 illustrates a front perspective view of a multifunctional spool tool 100 according to various other embodiments, the spool tool 100 is adapted to receive and retain a conventional lighter within a lighter clip portion 14 of the tool, adapted to receive and retain various-sized utility cord in a series of individual notches 13(*a*-*d*), collectively a notch series 130*a*, disposed along the spool tool, and further adapted to provide a cutting blade 40 for cutting utility cord. As shown in FIG. 7, a first notch series 130*a* comprises a plurality of notches disposed along a first elongated prong of the spool tool, and a second notch series 130*b* comprises a plurality of additional notches disposed along a second elongated prong of the spool tool, the second elongated prong being opposite of the first elongated prong. In this embodiment, the first and second notch series' are configured on opposing sides of the first and second elongated prongs of the spool tool. The tool further comprises a lanyard hole 12 for receiving a portion of a clip, band, chain, or similar attachment item for attaching with a belt, backpack, or an extension of a user's body.

The spool tool can be fabricated from aluminum or other metals, or composite materials such as plastics, or from wood. Additionally, the spool tool can be dipped, coated, painted, anodized, or otherwise aesthetically processed for configuring an aesthetic pattern about a surface of the spool tool body prior to assembly.

In accordance with an embodiment, a multifunctional spool tool comprises: a body portion, the body portion comprising a first winding edge and a second winding edge, each of the first and second winding edges being configured to receive one or more windings of a utility cord thereon; a first fork, the first fork extending outwardly from the body portion at a first side thereof and comprising a first elongated prong, and a second elongated prong separated from the first elongated prong by said first winding edge; and a second fork, the second fork extending outwardly from the body portion at a second side opposite of the first side and comprising a third elongated prong, and a fourth elongated prong separated from the third elongated prong by the second winding edge; and at least one of: a lighter clip, the lighter clip being configured to receive and retain a lighter therein; a cutting channel formed between the body portion and a safety finger extending therefrom, the cutting channel comprising a blade edge disposed therein for cutting the utility cord; one or more notches configured for receiving and retaining a portion of the utility cord during a fusing process; or a supplemental component selected from the group consisting of: a flashlight; compass; knife; fire starter; magnifying glass; screwdriver; measuring device; pen; storage device; magnesium striker; can opener; safety belt knife; skinning knife; tweezers; toothpick; and a signal mirror.

In another embodiment, a tool comprises an elongated body and a plurality of notches disposed along an edge thereof. In this embodiment, the tool does not comprise winding edges, but does include one or more notches disposed along the edge of the tool. The notches can each comprise a different size, can be ordered from one end to another end according to size, or can be the same size notches for receiving and holding a plurality of cords. It is preferred that each of the notches have a width between 0.5 mm and 5.0 mm. The tool may comprise notches disposed on multiple sides. In this regard, the tool comprises: an elongated body and a plurality of notches disposed along said elongated body, the notches each being between 0.5 mm and 5.0 mm in width, and ordered successively from a first small notch to a second notch, the second notch having a width that is larger than the first notch, and each successive notch being larger than a preceding notch.

Accordingly, in the above description a multi-functional spool tool is described having a spool body adapted to retain a length of winded utility cord thereon, a cutting blade adapted to cut a segment of the utility cord, and a fusing device adapted to fuse a terminal end of a freshly cut segment. The multi-functional spool tool may further comprise one or more supplemental components such as a flashlight; compass; knife; fire starter; magnifying glass; screwdriver; measuring device; pen; storage device; magnesium striker; can opener; safety belt knife; skinning knife; tweezers; toothpick; and signal mirror, a combination thereof, or a related component. In this regard an improved spooling device provides multifunctional application and enhanced portability when compared to traditional tools required to manage utility cord for military and recreational purposes.

Although specific embodiments have been described to enable those having skill in the art to make and use the invention, it should be noted that the features and benefits of the invention may be rearranged in a number of combinations to yield a spool tool having a substantially similar result. Accordingly, the illustrated embodiments are intended for illustrative purposes only and shall not limit the spirit and scope of the invention as set forth in the appended claims.

REFERENCED FEATURES spool tool (1; 100)
elongated prong (10*a*; 10*b*; 10*c*; 10*d*)
winding edge (11*a*; 11*b*)
lanyard hole (12)
notch (13)
clipping jaws (14*a*; 14*b*; 14*c*)
lighter clip (14)
safety finger (15)
blade channel (16)
teeth (17)
lighter stop (18)
housing cover (30)
housing cover apertures (31*a*; 31*b*)
housing aperture (32*a*; 32*b*)
fasteners (33*a*; 33*b*)
housing portion (35)
cutting blade (40)
lighter (50)
supplemental components (60; 60*a*; 60*b*; 60*c*; 60*d*)
notch series (130*a*; 130*b*)

The invention claimed is:

1. A multifunctional spool tool for use with utility cord, the spool tool comprising:

a body portion, the body portion comprising a receptacle housing portion disposed near a center thereof and four elongated prongs extending outwardly from the receptacle housing portion;

a channel disposed about one side of the body portion and having a blade edge exposed within said channel in a manner sufficient to provide cutting of the utility cord;

a lighter clip portion adapted to receive and retain a lighter; and a notch disposed about one of said elongated prongs, said notch being adapted to grip a portion of said utility cord for orienting an end thereof in a direction orthogonal to a surface of the body portion for providing stability during fusing of the cord;

wherein said spool tool is configured for multifunctional use including: storing said utility cord, cutting said utility cord, and fusing one or more ends of said utility cord.

2. The spool tool of claim 1, further comprising one or more supplemental components selected from the group consisting of: a flashlight; compass; knife; fire starter; magnifying glass; screwdriver; measuring device; pen; storage device; magnesium striker; can opener; safety belt knife; skinning knife; tweezers; toothpick; and a signal mirror.

3. The spool tool of claim 1, wherein said receptacle housing is configured to contain at least a portion of a cutting blade, wherein said blade edge forms an edge of the cutting blade.

4. The spool tool of claim 3, wherein said channel is disposed between said body portion and a safety finger extending from the body portion.

5. The spool tool of claim 1, said body portion comprising a winding surface for winding the utility cord about the body of the spool tool.

6. The spool tool of claim 5, said spool tool comprising a first fork, said first fork comprising a first elongated prong and a second elongated prong, each of said elongated prongs extending outwardly from the body portion at a first side thereof to form the first fork.

7. The spool tool of claim 6, further comprising a second fork extending from the body portion at a second side opposite of the first side.

8. A multifunctional spool tool, comprising:

a body portion, the body portion comprising a first winding edge and a second winding edge, each of the first and second winding edges being configured to receive one or more windings of a utility cord thereon;

a first fork, the first fork extending outwardly from the body portion at a first side thereof and comprising a first elongated prong, and a second elongated prong separated from the first elongated prong by said first winding edge; and a second fork, the second fork extending outwardly from the body portion at a second side opposite of the first side and comprising a third elongated prong, and a fourth elongated prong separated from the third elongated prong by said second winding edge; and at least one of:

a lighter clip, the lighter clip being configured to receive and retain a lighter therein;

a cutting channel formed between the body portion and a safety finger extending therefrom, the cutting channel comprising a blade edge disposed therein for cutting the utility cord;

a plurality of notches disposed along said body portion, the notches being configured for receiving and retaining a portion of the utility cord during a fusing process, the notches each being between 0.5 mm and 5.0 mm in width, and ordered successively from a first small notch to a second notch, the second notch having a width that is larger than the first notch, and each successive notch being larger than a preceding notch; and a supplemental component selected from the group consisting of: a flashlight; compass; knife; fire starter; magnifying glass; screwdriver; measuring device; pen; storage device; magnesium striker; can opener; safety belt knife; skinning knife; tweezers; toothpick; and a signal mirror.

9. A device for use with a cord, comprising a spool around which the cord can be wound so as to retain the cord; a cutting blade near a first side of the device for cutting the cord; a lighter clip near a second side of the device for holding a fire starting tool, the second side being generally opposite the first side; and a burn slot having an aperture with a diameter and a channel leading from the aperture to a side of the device, the channel being narrower than the diameter of the aperture.

10. The device of claim 9, wherein the spool has a cord-attachment aperture to which the cord can be attached, a spooling hub onto which the cord can be wound for storage, and two retaining flanges to help guide and retain the cord when it is wound onto the spool.

11. The device of claim 9, wherein the spool has a plurality of cord-attachment apertures so that multiple sections of cord can be wound onto the same spool.

12. The device of claim 9, wherein the spool has a cord-attachment aperture with an indented area around the aperture so that, if an end of the cord is passed through the aperture and a knot is tied in the end of the cord, the knot will be cradled in the indented area.

13. The device of claim 9, further comprising a blade guard on the first side of the device that partially blocks access to the cutting blade and forms a cutting slot so that the cord may be passed through the cutting slot and onto the cutting blade, thereby cutting the cord.

14. The device of claim 9, wherein the cutting blade is a replaceable utility blade.

15. The device of claim 9, wherein the lighter clip includes at least 3 flanges adapted to alternately pass above and below a cigarette lighter, so that the flanges cooperate to releasably retain the cigarette lighter.

16. The device of claim 9, further comprising a plurality of burn slots having differently-sized apertures to be used with different diameters of cord.

17. The device of claim 9, further comprising a lanyard hole that is located substantially on the same line as a cutting edge of the cutting blade.

18. The device of claim 9, further comprising a length of cord having a diameter that is substantially similar to the diameter of the burn slot aperture, so that the length of cord can be pulled through the aperture and remove excess material from sides of the length of cord.

19. The device of claim 9, further comprising from 100 feet to 150 feet of paracord, wherein the paracord fits and smoothly passes through the burn slot aperture.

* * * * *